US011542896B2

(12) United States Patent
Dudar et al.

(10) Patent No.: US 11,542,896 B2
(45) Date of Patent: Jan. 3, 2023

(54) MULTI-PATH PURGE EJECTOR SYSTEM IN AN EVAPORATIVE EMISSIONS CONTROL SYSTEM

(71) Applicant: Ford Global Technologies, LLC, Dearborn, MI (US)

(72) Inventors: Aed Dudar, Canton, MI (US); Eric A. Macke, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 41 days.

(21) Appl. No.: 17/079,221

(22) Filed: Oct. 23, 2020

(65) Prior Publication Data

US 2022/0128018 A1 Apr. 28, 2022

(51) Int. Cl.

| | |
|---|---|
| ***F02M 25/08*** | (2006.01) |
| ***F02D 41/00*** | (2006.01) |
| *F02D 41/22* | (2006.01) |

(52) U.S. Cl.

CPC ..... *F02M 25/0836* (2013.01); *F02D 41/004* (2013.01); *F02D 2041/224* (2013.01); *F02D 2200/0406* (2013.01); *F02D 2200/703* (2013.01); *F02M 25/0854* (2013.01)

(58) Field of Classification Search

CPC ..... F02M 25/0836; F02M 25/0827; F02M 25/089; F02M 25/0854; F02D 41/004; F02D 2041/224; F02D 2200/0406; F02D 2200/703

See application file for complete search history.

(56) References Cited

U.S. PATENT DOCUMENTS

| | | | | |
|---|---|---|---|---|
| 5,005,550 | A * | 4/1991 | Bugin, Jr. | F02M 25/089 123/520 |
| 9,410,507 | B2 | 8/2016 | Pearce et al. | |
| 9,528,473 | B2 * | 12/2016 | Dudar | F02D 41/0007 |
| 9,856,828 | B2 * | 1/2018 | Dudar | F02M 25/0836 |
| 10,138,827 | B2 | 11/2018 | Dudar | |
| 11,008,980 | B1 * | 5/2021 | Koo | F02D 41/0002 |
| 2013/0319378 | A1 * | 12/2013 | Haag | B60K 15/03504 73/40.5 R |

* cited by examiner

*Primary Examiner* — Gonzalo Laguarda

(74) *Attorney, Agent, or Firm* — Vincent Mastrogiacomo; McCoy Russell LLP

(57) ABSTRACT

Methods and systems are provided for diagnostics and subsequent cleaning of an ejector in a fuel vapor purge system of a vehicle with a boosted internal combustion engine. In one example, a method may include, in response to indication of blockage in a fuel vapor purge system, a purge system valve may be actuated to a position enabling routing of contaminants blocking the ejector to an engine intake manifold, thereby cleaning the ejector.

16 Claims, 6 Drawing Sheets

MULTI-PATH PURGE EJECTOR SYSTEM IN AN EVAPORATIVE EMISSIONS CONTROL SYSTEM

FIELD

The present description relates generally to methods and systems for cleaning a contaminated ejector in a fuel vapor recovery system for a vehicle with a boosted internal combustion engine.

BACKGROUND/SUMMARY

Vehicles may be fitted with evaporative emission control systems such as onboard fuel vapor recovery systems. Such systems capture and reduce release of vaporized hydrocarbons to the atmosphere, for example fuel vapors released from a vehicle gasoline tank during refueling. Specifically, the vaporized hydrocarbons (HCs) are stored in a fuel vapor canister packed with an adsorbent which adsorbs and stores the vapors. At a later time, when the engine is in operation, the evaporative emission control system allows the vapors to be purged into the engine intake manifold for use as fuel. The fuel vapor recovery system may include one more check valves, ejectors, and/or controller actuatable valves for facilitating purge of stored vapors under boosted or non-boosted engine operation.

Various approaches have been developed for detecting undesired evaporative emissions and/or degraded components in such fuel vapor recovery systems. One example approach is shown by Dudar in U.S. Pat. No. 10,138,827. Therein, a plurality of check valves and an ejector are included in a dual path purge system to effectively purge a canister of the evaporative emissions control system storing fuel vapors during natural aspiration (e.g., non-boosted) operation and boosted operation of the engine. Check valve functionality may be selectively diagnosed during operation in the natural aspirated and boosted operations.

However, the inventors herein have recognized potential issues with such systems. As one example, air through the ejector creates a vacuum during boosted operating conditions to facilitate purging of the canister during booster engine operation. However, due to contaminants flowing through the ejectors, the nozzle of the ejector may be blocked thereby hindering generation of vacuum at the ejector. Prolonged operation of the engine with a blocked ejector may delay purging of the canister which may cause an undesired decrease in emissions quality.

In one example, the issues described above may be addressed by a method for an engine of a vehicle, comprising: in response to indication of blockage in a fuel vapor purge system, actuating a purge system valve to a second position to route contaminants from the ejector to an engine intake manifold. In this way, by including a two-way valve in the fuel vapor recovery system, the canister may be purged during both naturally aspirated and boosted engine conditions, and further the ejector may be cleaned using intake manifold vacuum during naturally aspirated operation.

As one example, a multi-path purge system of a fuel vapor recovery system may include a first check valve coupled to a first purge line between a canister purge valve (CPV) and the engine intake manifold, the first check valve opening during naturally aspirated engine operation to purge the canister to the engine intake. The purge system may include a second check valve coupled to a second purge line between the CPV and the engine inlet upstream of a compressor. An ejector may be housed in the second purge line to generate a vacuum in the second purge line during boosted engine operation, the vacuum causing the second check valve to open and allowing purging of the canister to the engine inlet. A two-way valve may be coupled to the fuel vapor recovery system upstream of the ejector. The two-way valve may be actuated to a first position to allow fluidic communication of the engine intake manifold downstream of the compressor and a charge air cooler with the ejector to allow compressed air to flow through the ejector generating vacuum during the boosted engine operation. During boosted engine operation, a diagnostics of the ejector may be carried out by closing a canister purge solenoid (CVS) and opening the CPV and monitoring vacuum build in the fuel vapor system. A clogged ejector may be diagnosed in response to a lower than threshold vacuum build while the EVAP system is indicated to be non-degraded (such as without any leaks). Upon diagnosis of a clogged ejector, during naturally aspirated engine operation, the two-way valve may be actuated to a second position to allow fluidic communication of the engine intake manifold downstream of a throttle with the ejector. The contaminants lodged in the ejector may be sucked to the intake manifold by engine vacuum freeing the clogging. The mitigating cycle for the clogged ejector may be repeated for a number of cycles to clear all contaminants.

In this way, by monitoring vacuum build-up in the fuel vapor system during a boosted engine operation, a clogged ejector may be diagnosed and appropriate mitigating actions may be undertaken. The technical effect of including a two-way valve in the fuel vapor recovery system is that the canister may be purged during both naturally aspirated and boosted engine operations, and cleaning of a contaminated ejector may be carried out using engine vacuum. By opportunistically diagnosing a clogged ejector and then mitigating the clog, purging of the canister may be continued during boosted engine operation. Overall, by ensuring effective purging of the canister during all engine operating conditions, emissions quality may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1A:
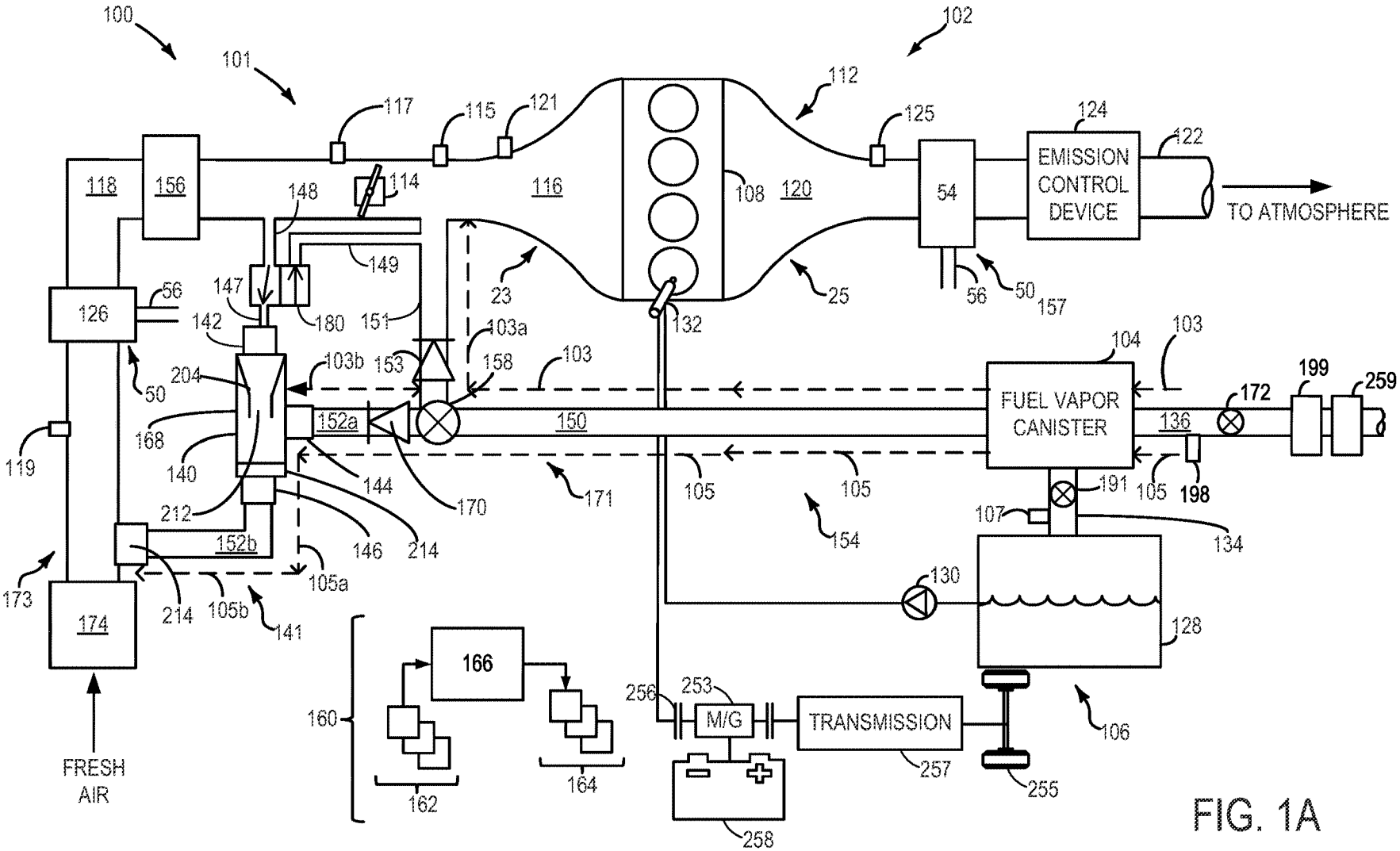
FIG. 1A shows a schematic diagram of a multi-path purge system of the fuel vapor recovery system of a vehicle system operating in a first mode.
Figure 1B:
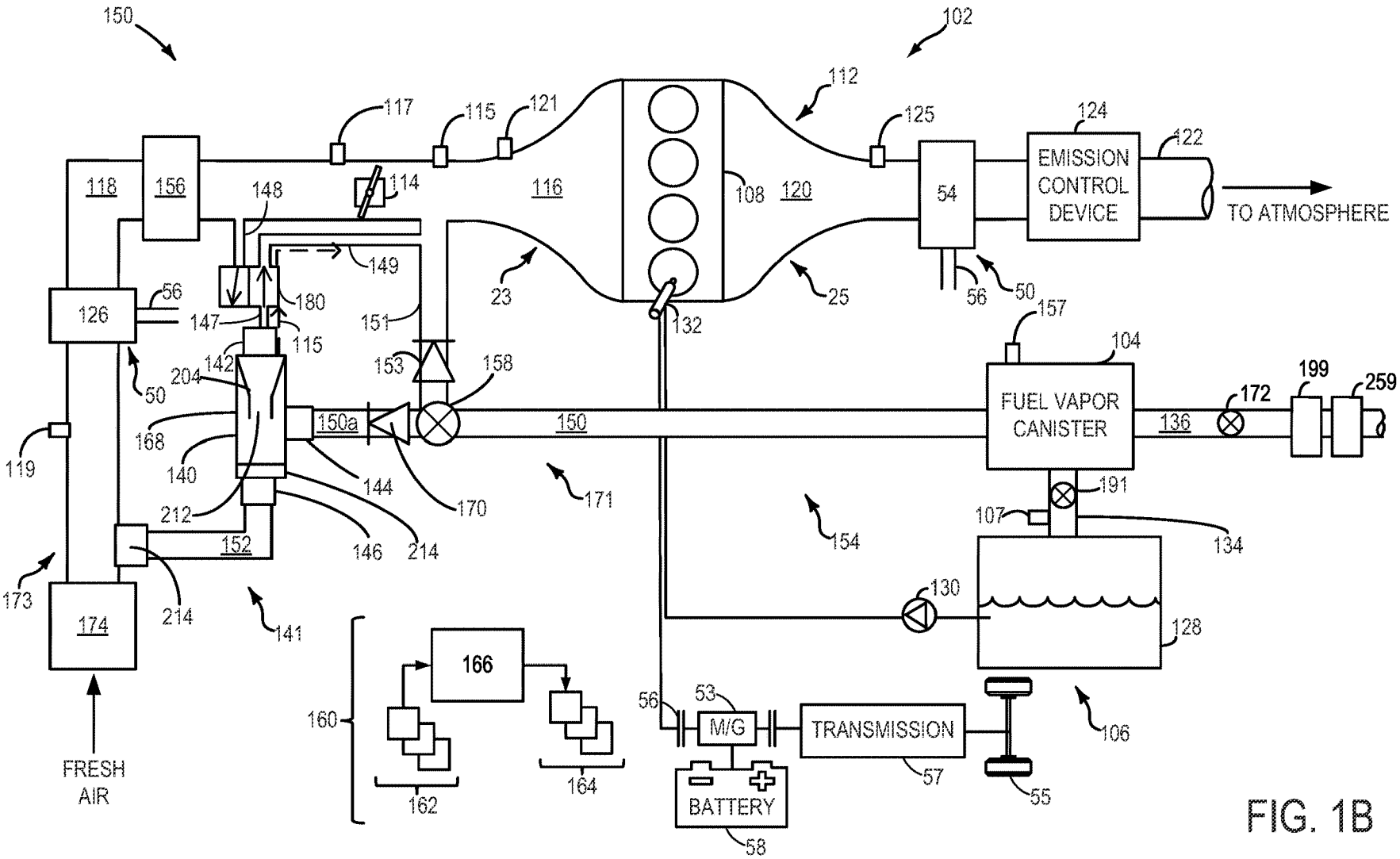
FIG. 1B shows a schematic diagram of the multi-path purge system of the fuel vapor recovery system operating in a second mode.

The following description relates to systems and methods for cleaning a contaminated ejector in a fuel vapor recovery system for a vehicle. An example fuel system and a fuel vapor recovery system including a multi-path purge system in a hybrid vehicle is depicted at FIGS. 1A-1B. A controller may be configured to carry out diagnostic routines of the EVAP system and an ejector of the fuel vapor recovery system based on example routines of FIGS. 2 and 3. In response to detection of possible clogging in the ejector of the fuel vapor recovery system, one or more mitigating cycles may be carried out based on the example routine of FIG. 4 to clear the ejector. An example of diagnosing and mitigating a clogged ejector is shown in FIG. 5.

Turning to the figures, FIG. 1A shows a schematic depiction 100 of a vehicle system 101 with a multi-path purge system of the fuel vapor recovery system operating in a first mode. The vehicle system 101 includes an engine system 102 coupled to a fuel vapor recovery system (evaporative emissions control system) 154 and a fuel system 106. The engine system 102 may include an engine 112 having a plurality of cylinders 108. The engine 112 includes an engine intake 23 and an engine exhaust 25. The engine intake 23 includes a throttle 114 fluidly coupled to the engine intake manifold 116 via an intake passage 118. An air filter 174 is positioned upstream of throttle 114 in intake passage 118. The engine exhaust 25 includes an exhaust manifold 120 leading to an exhaust passage 122 that routes exhaust gas to the atmosphere. The engine exhaust 122 may include one or more emission control devices 124, which may be mounted in a close-coupled position in the exhaust. One or more emission control devices may include a three-way catalyst, lean NOx trap, diesel particulate filter, oxidation catalyst, etc. It will be appreciated that other components may be included in the vehicle system, such as a variety of valves and sensors, as further elaborated below.

Throttle 114 may be located in intake passage 118 downstream of a compressor 126 of a boosting device, such as turbocharger 50, or a supercharger. Compressor 126 of turbocharger 50 may be arranged between air filter 174 and throttle 114 in intake passage 118. Compressor 126 may be at least partially powered by exhaust turbine 54, arranged between exhaust manifold 120 and emission control device 124 in exhaust passage 122. Compressor 126 may be coupled to exhaust turbine 54 via shaft 56. Compressor 126 may be configured to draw in intake air at atmospheric air pressure into an air induction system (AIS) 173 and boost it to a higher pressure. Using the boosted intake air, a boosted engine operation may be performed.

An amount of boost may be controlled, at least in part, by controlling an amount of exhaust gas directed through exhaust turbine 54. In one example, when a larger amount of boost is requested, a larger amount of exhaust gases may be directed through the turbine. Alternatively, for example when a smaller amount of boost is requested, some or all of the exhaust gas may bypass turbine 54 via a turbine bypass passage as controlled by wastegate (not shown). An amount of boost may additionally or optionally be controlled by controlling an amount of intake air directed through compressor 126. Controller 166 may adjust an amount of intake air that is drawn through compressor 126 by adjusting the position of a compressor bypass valve (not shown). In one example, when a larger amount of boost is requested, a smaller amount of intake air may be directed through the compressor bypass passage.

Fuel system 106 may include a fuel tank 128 coupled to a fuel pump system 130. The fuel pump system 130 may include one or more pumps for pressurizing fuel delivered to fuel injectors 132 of engine 112. While only a single fuel injector 132 is shown, additional injectors may be provided for each cylinder. For example, engine 112 may be a direct injection gasoline engine and additional injectors may be provided for each cylinder. It will be appreciated that fuel system 106 may be a return-less fuel system, a return fuel system, or various other types of fuel system. In some examples, a fuel pump may be configured to draw the tank's liquid from the tank bottom. Vapors generated in fuel system 106 may be routed to fuel vapor recovery system (evaporative emissions control system) 154, described further below, via conduit 134, before being purged to the engine intake 23.

Fuel vapor recovery system 154 (herein referred to as evaporative emissions control system, or evaporative emissions system) includes a fuel vapor retaining device, depicted herein as fuel vapor canister 104. Canister 104 may be filled with an adsorbent capable of binding large quantities of vaporized HCs. In one example, the adsorbent used is activated charcoal. Canister 104 may receive fuel vapors from fuel tank 128 through conduit 134. While the depicted example shows a single canister, it will be appreciated that in alternate embodiments, a plurality of such canisters may be connected together. Canister 104 may communicate with the atmosphere through vent 136. In some examples, vent line 136 may include an air filter 259 disposed therein upstream of a canister 104. A canister vent valve (also referred herein as canister vent solenoid (CVS)) 172 may be located along vent 136, coupled between the fuel vapor canister and the atmosphere, and may adjust a flow of air and vapors between canister 104 and the atmosphere. In one example, operation of canister vent valve 172 may be regulated by a solenoid (not shown). For example, based on whether the canister is to be purged or not, the canister vent valve may be opened or closed.

In some examples, an evaporative level check monitor (ELCM) (not shown) may be disposed in vent 136 and may be configured to control venting and/or assist in detection of undesired evaporative emissions. As an example, ELCM may include a vacuum pump for applying negative pressure to the fuel system when administering a test for undesired evaporative emissions. In some embodiments, the vacuum pump may be configured to be reversible. In other words, the vacuum pump may be configured to apply either a negative pressure or a positive pressure on the evaporative emissions system 154 and fuel system 106. ELCM may further include a reference orifice and a pressure sensor. A reference check may thus be performed whereby a vacuum may be drawn across the reference orifice, where the resulting vacuum level comprises a vacuum level indicative of an absence of undesired evaporative emissions. For example, following the reference check, the fuel system 106 and evaporative emissions system 154 may be evacuated by the ELCM vacuum pump. In the absence of undesired evaporative emissions, the vacuum may pull down to the reference check vacuum level. Alternatively, in the presence of undesired evaporative emissions, the vacuum may not pull down to the reference check vacuum level.

In some examples, evaporative emissions system 154 may further include a bleed canister 199. Hydrocarbons that desorb from canister 104 (also referred to as the "main canister") may be adsorbed within the bleed canister. Bleed canister 199 may include an adsorbent material that is different than the adsorbent material included in main canister 104. Alternatively, the adsorbent material in bleed canister 199 may be the same as that included in main canister 104.

A hydrocarbon sensor 198 may be present in evaporative emissions system 154 to indicate the concentration of hydrocarbons in vent 136. As illustrated, hydrocarbon sensor 198 is positioned between main canister 104 and bleed canister 199. A probe (e.g., sensing element) of hydrocarbon sensor 198 is exposed to and senses the hydrocarbon concentration of fluid flow in vent 136. Hydrocarbon sensor 198 may be used by the engine control system 160 for determining breakthrough of hydrocarbon vapors from main canister 104, in one example. Furthermore, in some examples, one or more oxygen sensors 121 may be positioned in the engine intake 116, or coupled to the canister 104 (e.g., downstream of the canister), to provide an estimate of canister load.

Conduit 134 may include a fuel tank isolation valve 191. Among other functions, fuel tank isolation valve 191 may allow the fuel vapor canister 104 to be maintained at a low pressure or vacuum without increasing the fuel evaporation rate from the tank (which would otherwise occur if the fuel tank pressure were lowered). The fuel tank 128 may hold a plurality of fuel blends, including fuel with a range of alcohol concentrations, such as various gasoline-ethanol blends, including E10, E85, gasoline, etc., and combinations thereof.

Fuel vapor recovery system 154 may include a dual path fuel vapor purge system 171. Purge system 171 is coupled to canister 104 via a conduit (purge line) 150. Conduit 150 may include a canister purge valve (CPV) 158 disposed therein. Specifically, CPV 158 may regulate the flow of vapors along duct 150. The quantity and rate of vapors released by CPV 158 may be determined by the duty cycle of an associated CPV solenoid (not shown). In one example, the duty cycle of the CPV solenoid may be determined by controller 166 responsive to engine operating conditions, including, for example, an air-fuel ratio. By commanding the CPV to be closed, the controller may seal the fuel vapor canister from the fuel vapor purging system, such that no vapors are purged via the fuel vapor purging system. In contrast, by commanding the CPV to be open, the controller may enable the fuel vapor purging system to purge vapors from the fuel vapor canister.

Fuel vapor canister 104 operates to store vaporized hydrocarbons (HCs) from fuel system 106. Under some operating conditions, such as during refueling, fuel vapors present in the fuel tank may be displaced when liquid is added to the tank. The displaced air and/or fuel vapors may be routed from the fuel tank 128 to the fuel vapor canister 104, and then to the atmosphere through vent 136. In this way, an increased amount of vaporized HCs may be stored in fuel vapor canister 104. During a later engine operation, the stored vapors may be released back into the incoming air charge via fuel vapor purging system 171.

Conduit 150 is coupled to an ejector 140 in an ejector system 141 and includes a second check valve (CV2) 170 disposed therein, in a second purge conduit 152*a*, between ejector 140 and CPV 158. Second check valve (CV2) 170 may avert intake air from flowing from the ejector into a second purge conduit 152*a* and conduit 150, while allowing flow of air and fuel vapors from conduit 150 into ejector 140. CV2 170 may be a vacuum-actuated check valve, for example, that opens responsive to vacuum derived from ejector 140. A third purge conduit 152*b* may couple the ejector 140 to the intake conduit 118 upstream of the compressor 126.

A first purge conduit 151 couples conduit 150 to intake 23 at a position within conduit 150 between check valve 170 and CPV 158 and at a position in intake 23 downstream of throttle 114. A first purge conduit 151 may include a first check valve (CV1) 153 disposed therein. First check valve (CV1) 153 may avert intake air from flowing through from intake manifold 116 into conduit 150, while allowing flow of fluid and fuel vapors from conduit 150 into intake manifold 116 via the first purge conduit 151 during a canister purging event. CV1 may be a vacuum actuated check valve, for example, that opens responsive to vacuum derived from intake manifold 116.

A first end of the ejector 140 may be selectively coupled to the intake manifold 116 downstream of the charge air cooler 156 via a first passage 148 and to the first purge conduit 151 via a second passage 149. The ejector may fluidically communicate to either the first passage 148 or the second passage via a two-way purge system valve 180 coupled to the ejector via a third passage 147. In the first position of the two-way valve 180 (as shown in FIG. 1A), the ejector 140 and the third passage 147 may be in fluidic communication with intake manifold 116 via the first passage 148. In the first position of the two-way valve 180 (as shown in FIG. 1B), the ejector 140 and the third passage 147 may be in fluidic communication with first purge conduit 151 via the second passage 149.

The third passage 147 may be coupled to ejector 140 at a first port or inlet 142. Ejector 140 includes a second port 144 or inlet coupling ejector 140 to the second purge conduit 152*a*. Ejector 140 is coupled to intake 23 at a position upstream of throttle 114 and downstream of compressor 126 via a conduit 148. A third port 146 or outlet of ejector 140 may be coupled to the intake conduit 118 at a position upstream of compressor 126 via the third purge conduit 152*b* and a shut-off valve 214. In some example, the shut-off valve 214 may be eliminated. However, in other examples, shut-off valve may be integrated with ejector 140 and directly coupled thereto.

Shut-off valve 214 may be hard-mounted directly to air induction system 173 along conduit 118 at a position between air filter 174 and compressor 126. For example, shut-off valve 214 may be coupled to an existing AIS nipple or other orifice, e.g., an existing SAE male quick connect port, in AIS 173. Shut-off valve 214 may be configured to close in response to undesired emissions detected downstream of third, outlet port 146 of ejector 140.

Ejector 140 includes a housing 168 coupled to ports 146, 144, and 142. For example, air from intake conduit 118 downstream of compressor 126 may be directed into ejector 140 via first, inlet port 142 and may flow through the ejector and exit the ejector at third, outlet port 146 before being directed into intake conduit 118 at a position upstream of compressor 126. This flow of air through the ejector may create a vacuum due to the Venturi effect at second port 144 so that vacuum is provided to conduit second purge conduit 152*a* and conduit 150 via second port 144 during boosted operating conditions. In particular, a low pressure region is created adjacent to second port 144 which may be used to draw purge vapors from the canister into ejector 140.

Ejector 140 includes a nozzle 204 comprising an orifice which converges in a direction from first, inlet port 142 toward second port (suction inlet) 144 so that when air flows through ejector 140 in a direction from first port 142 towards third port 146, a vacuum is created at second port 144 due to the Venturi effect. This vacuum may be used to assist in fuel vapor purging during certain conditions, e.g., during boosted engine operations. In one example, ejector 140 is a passive component. That is, ejector 140 is designed to provide vacuum to the fuel vapor purge system via second purge conduit 152*a* and conduit 150 to assist in purging under various conditions, without being actively controlled. Thus, whereas CPV 158 and throttle 114 may be controlled via controller 166, for example, ejector 140 may be neither controlled via controller 166 nor subject to any other active control. In another example, the ejector may be actively controlled with a variable geometry to adjust an amount of vacuum provided by the ejector to the fuel vapor recovery system via second purge conduit 152*a* and conduit 150.

The fuel vapor purging system 171 may be operated to purge fuel vapors from the canister 104 to the engine 112 during both naturally aspirated and boosted operation of the engine. During naturally aspirated operation of the engine, the engine intake manifold may be under vacuum conditions. For example, intake manifold vacuum conditions may be present during an engine idle condition, with manifold pressure below atmospheric pressure by a threshold amount. The intake manifold vacuum may actuate the first check valve to an open position allowing fluidic communication between the canister 104 and the intake manifold 116 via the conduit 150, CPV 158, and the first purge conduit 151. This vacuum in the intake system 23 may draw fuel vapor from the canister through conduits 150 and first purge conduit 151 into intake manifold 116, as represented by dashed line(s) 103 and 103*a*. During purging of the canister while the engine is naturally aspirated, due to the second check valve 170 being in a closed position, purged fuel vapors may not substantially flow through the ejector 140 and the two-way valve 180.

During engine operation under boosted conditions such as during which the compressor is in operation, the fuel vapors may be purged through ejector 140. For example, the boosted conditions may include one or more of a high engine load condition and a super-atmospheric intake condition, with intake manifold pressure greater than atmospheric pressure by a non-zero threshold amount.

During operation of the multi-path fuel vapor purge system 171 in a first mode, as shown in FIG. 1A, the two-way valve 180 is actuated to a first position wherein the first passage 148 is in fluidic communication with the third passage 147 and the ejector 140. With the two-way valve in the first position, fluidic communication between the ejector 140 and the first purge conduit 151 via the second passage 149 may be disconnected. The purge system 171 is operated in the first mode during purging of the fuel vapor from the canister 104 to the engine 112. Operation of the multi-path fuel vapor purge system 171 in a second mode with the two-way valve in the second position is described in relation to FIG. 1B.

Fresh air may enter intake passage 118 at air filter 174 and compressor 126 may pressurize the air in intake passage 118, such that intake manifold pressure is positive. Pressure in intake passage 118 upstream of compressor 126 is lower than intake manifold pressure during operation of compressor 126, and this pressure differential induces a flow of fluid from intake passage 118, the first passage 148, and the two-way valve 180, and into ejector 140 via first port (ejector inlet) 142. This fluid may include a mixture of air and fuel, in some examples. After the fluid flows into the ejector via the port 142, it flows through the converging orifice 212 in nozzle 204 in a direction from first port 142 towards third, outlet port 146. Because the diameter of the nozzle gradually decreases in a direction of this flow, a low pressure zone is created in a region of orifice 212 adjacent to second port (suction inlet) 144. The pressure in this low pressure zone may be lower than a pressure in the second purge conduit 152*a* and conduit 150. Due the vacuum generated at the ejector, the second check valve 170 may be actuated to an open position. This pressure differential may provide a vacuum to conduit 150 to draw fuel vapor from canister 104, as indicated via dashed line(s) 105. This pressure differential may further induce flow of fuel vapors from the fuel vapor canister, through the CPV, and into second port 144 of ejector 140. Upon entering the ejector, the fuel vapors may be drawn along with the fluid from the intake manifold out of the ejector via third, outlet port 146 and into intake 118 at a position upstream of compressor 126, as indicated via dashed lines 105*a* and 105*b*. Operation of compressor 126 then draws the fluid and fuel vapors from ejector 140 into intake passage 118 and through the compressor. After being compressed by compressor 126, the fluid and fuel vapors flow through charge air cooler 156, for delivery to intake manifold 116 via throttle 114.

Thus, herein, it may be understood that the fuel vapor canister may be coupled to an air intake of the engine through a first path having a first check valve 153, where the first path may include conduit 150 and a first purge conduit 151. Furthermore, it may be understood that the fuel vapor canister may be coupled to an air intake of the engine through a second path having a second check valve 170. The second path may include conduit 150, second purge conduit 152*a*, and third purge conduit 152*b*.

Vehicle system 101 may further include a control system 160. Control system 160 is shown receiving information from a plurality of sensors 162 (various examples of which are described herein) and sending control signals to a plurality of actuators 164 (various examples of which are described herein). As one example, sensors 162 may include an exhaust gas sensor 125 (located in exhaust manifold 120) and various temperature and/or pressure sensors arranged in intake system 23. For example, a pressure or airflow sensor 115 in intake conduit 118 downstream of throttle 114, a pressure or air flow sensor 117 in intake conduit 118 between compressor 126 and throttle 114, a pressure or air flow sensor 119 in intake conduit 118 upstream of compressor 126, and a fuel system pressure sensor (fuel tank pressure transducer) 107 in a fuel system conduit 134. Other sensors such as additional pressure, temperature, air/fuel ratio, and composition sensors may be coupled to various locations in the vehicle system 101. As another example, actuators 164 may include fuel injectors 132, throttle 114, compressor 126, a fuel pump of pump system 130, etc. The control system 160 may include an electronic controller 166. The controller may receive input data from the various sensors, process the input data, and trigger the actuators in response to the processed input data based on instruction or code programmed therein corresponding to one or more routines.

Diagnostic tests may be periodically performed on the evaporative emissions control system 154, fuel system 106, and the duel path fuel vapor purge system 171 in order to indicate the presence or absence of undesired evaporative emissions.

As an example, a blockage in the fuel vapor purge system 171 may be indicated in response to a pressure in a fuel tank being above a threshold pressure upon completion of a diagnostic routine of the fuel vapor purge system carried out during boosted operation of the engine, the threshold pressure corresponding to a lower than atmospheric pressure. The diagnostic routine may includes, during the boosted operation of the engine, the CVV 172 may be closed, the CPV 158 may be opened, the two-way purge system valve 180 may be actuated to the first position to route compressed air from downstream of the compressor 126 to upstream of the compressor 126 via the ejector 140, and monitoring a change in the pressure in the fuel tank over a threshold duration. The routing of compressed air through the ejector 140 generates the lower than threshold pressure at the ejector which causes evacuation of the EVAP system through the purge line 150. In response to indication of blockage in the fuel vapor purge system 171, during operation of the engine under naturally aspirated conditions, actuating the two-way purge system valve 180 to the second position and cleaning the ejector 140 by routing contaminants from the ejector 140 to the engine intake manifold 116 via the purge system valve 180 and a first purge conduit 151. The cleaning of the ejector may be repeated over two or more cycles of engine operation under naturally aspirated conditions. After cleaning the ejector by routing contaminants from the ejector 140 to the engine intake manifold 116, during an immediately subsequent boosted engine operation, the diagnostic routine of the fuel vapor purge system may be repeated, and in response to the pressure in the fuel tank reaching the threshold pressure upon completion of the repeated diagnostic routine of the fuel vapor purge system, the fuel vapor purge system 171 may be indicated as undegraded. However, in response to the pressure in the fuel tank being above the threshold pressure upon completion of the repeated diagnostic routine of the fuel vapor purge system, degradation of the fuel vapor purge system may be indicated, and purging of the fuel vapor canister 104 may be disabled during subsequent boosted engine operations.

In some examples, vehicle system 101 may be a hybrid vehicle system with multiple sources of torque available to one or more vehicle wheels 255. In other examples, vehicle system 101 is a conventional vehicle with only an engine, or an electric vehicle with only electric machine(s). In the example shown, vehicle system 101 includes engine 112 and an electric machine 253. Electric machine 253 may be a motor or a motor/generator. Crankshaft of engine 112 and electric machine 253 are connected via a transmission 257 to vehicle wheels 255 when one or more clutches 256 are engaged. In the depicted example, a first clutch 256 is provided between crankshaft and electric machine 253, and a second clutch 256 is provided between electric machine 253 and transmission 257. Controller 12 may send a signal to an actuator of each clutch 256 to engage or disengage the clutch, so as to connect or disconnect crankshaft 140 from electric machine 253 and the components connected thereto, and/or connect or disconnect electric machine 253 from transmission 257 and the components connected thereto. Transmission 257 may be a gearbox, a planetary gear system, or another type of transmission. The powertrain may be configured in various manners including as a parallel, a series, or a series-parallel hybrid vehicle.

Electric machine 253 receives electrical power from a traction battery 258 to provide torque to vehicle wheels 255. Electric machine 253 may also be operated as a generator to provide electrical power to charge battery 258, for example during a braking operation.

FIG. 1B shows a schematic depiction 150 of the vehicle system 100 with the multi-path purge system 171 of the fuel vapor recovery system operating in a second mode. The components previously described are numbered similarly and not reintroduced. During operation of the multi-path fuel vapor purge system 171 in a second mode, the two-way valve 180 is actuated to a second position wherein the first purge conduit 151 and the second passage 149 are in fluidic communication with the third passage 147 and the ejector 140. With the two-way valve in the second position, fluidic communication between the ejector 140 and the first passage 148 may be discontinued.

The multi-path purge system 171 may be operated in the second mode upon detection of clogging in the ejector 140 following a diagnostics routine of the purge system 171. During naturally aspirated operation of the engine, due to the second position of the two-way valve, the contaminants may be sucked into the intake manifold 116 via each of the first port 142 of the ejector 140, the third passage 147, the valve 180, the second passage 149, and the first purge conduit 151. The vacuum in the intake manifold 116 may facilitate in sucking out the contaminants from the orifice 212 of the ejector 140 to the engine where it is combusted. Details of the cleaning of a contaminated ejector 140 are discussed in FIG. 4.

In this way, the systems of FIGS. 1A, B provide for a controller with computer-readable instructions stored on non-transitory memory that when executed cause the controller to: during operation of a compressor coupled to an intake passage, actuate a two-way valve coupled between an ejector and an engine intake manifold to a first position allowing flow of compressed air from downstream of the compressor to upstream of the compressor through the ejector to generate a lower than threshold pressure at the ejector, actuate a canister vent valve (CVV) housed in a vent line coupled to a fuel vapor canister to a closed position, actuate a canister purge valve (CPV) housed in a purge line coupled to the fuel vapor canister to an open position. A fuel system pressure may be monitored via a pressure sensor coupled to a fuel line coupling a fuel tank to the fuel vapor canister over a threshold duration, and in response to the fuel system pressure remaining above a threshold pressure, a blockage in one of the ejector and a check valve housed in a purge line between the CPV and the ejector may be indicated, the threshold pressure lower than atmospheric pressure.

Figure 2:
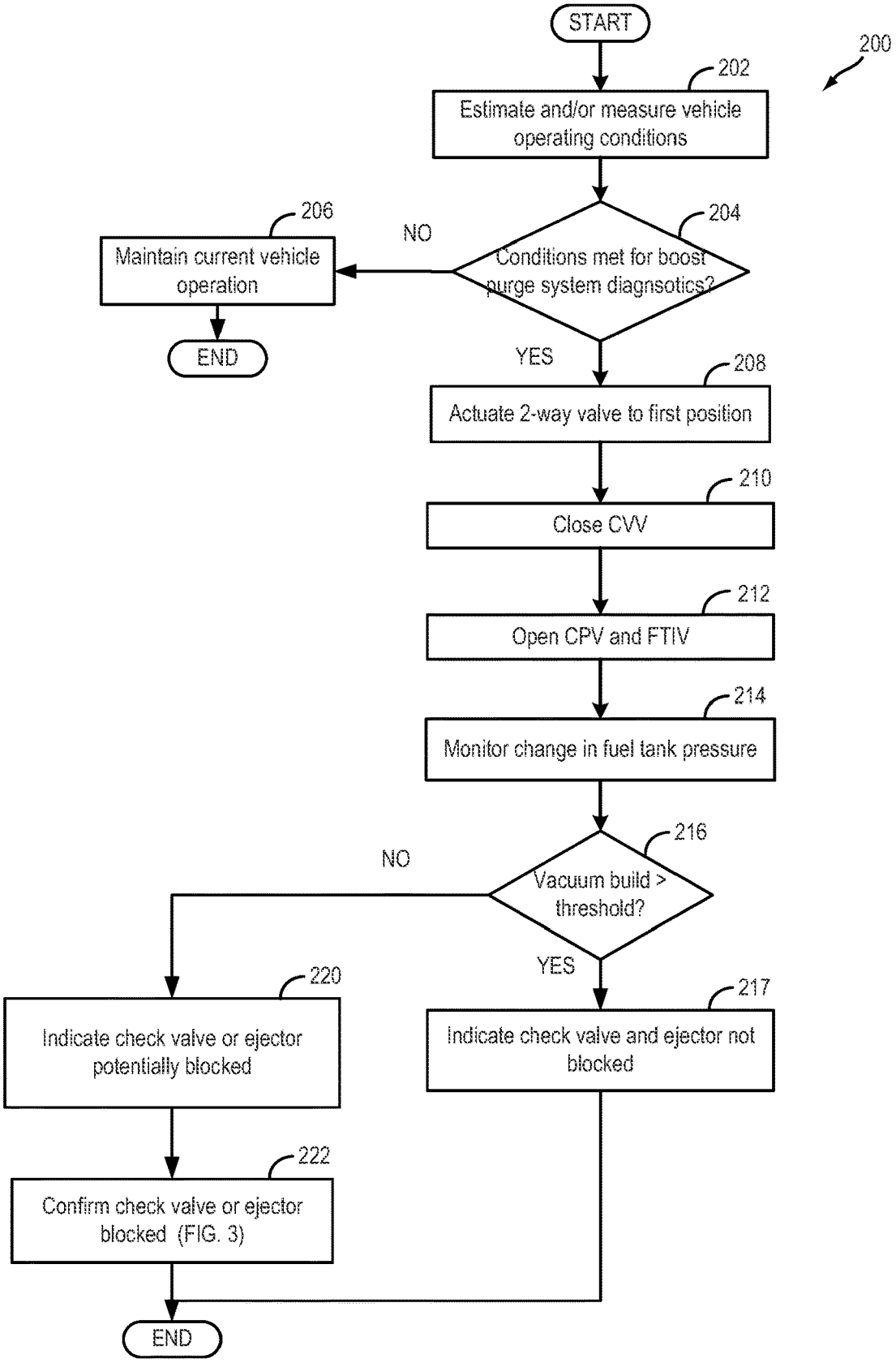
FIG. 2 shows a flowchart for an example method for diagnostics of an ejector of the multi-path purge system.

Turning now to FIG. 2, an example method for carrying out diagnostics of an ejector (such as ejector 140 in FIG. 1A) of the multi-path fuel vapor purge system (such as purge system 171 in FIG. 1A) of an engine evaporative emissions control system (such as EVAP system 154 in FIG. 1A) is shown at 200. The method enables detection of contaminants clogging the ejector which may adversely affect operation of the purge system. Instructions for carrying out method 300 may be executed by a controller based on instructions stored on a memory of the controller and in conjunction with signals received from sensors of the engine system, such as the sensors described above with reference to FIGS. 1A-1B. The controller may employ engine actuators of the engine system to adjust engine operation, according to the methods described below.

At 202, the method includes estimating and/or measuring vehicle and engine operating conditions. These include, for example, engine speed, torque demand, manifold pressure, manifold air flow, ambient conditions (ambient temperature, pressure, and humidity, for example), engine dilution, etc. It may be estimated if the engine is operating under naturally aspirated or under boosted condition. For example, the boost conditions may include one or more of a higher engine load condition and a super-atmospheric intake condition, with intake manifold pressure greater than atmospheric pressure by a non-zero threshold amount. During boosted engine operation, an intake compressor may be operated either via an exhaust turbine or an electric motor to provide the boost pressure. The engine may be operated in the naturally aspirated condition during a lower engine load condition when the compressor is not operated to provide boost pressure. In absence of boost pressure, engine operation causes a lower pressure in the intake manifold.

At 204, the routine includes determining if conditions are met for carrying out diagnostics of the multi-path fuel vapor purge system during operation of the engine in a boosted condition. The conditions may include the engine operating under boosted condition with the intake compressor operating to provide a higher boost pressure at the intake manifold. The conditions further include, a longer than threshold duration (such as more than one day, one week, 30 days, etc.) being elapsed since a previous diagnostics routine of the purge system has been carried out. The conditions may further include no other diagnostics of the EVAP system being currently carried out. If it is determined that one or more conditions for carrying out diagnostics of the purge system during operation of the engine in a boosted condition is not met such as during naturally aspirated engine operation, at 206, current vehicle operation may be maintained without initiating purge system diagnostics.

If it is determined that conditions are met for carrying out diagnostics of the purge system, at 208, a purge system valve (such as two-way valve 180 in FIG. 1A) coupling the ejector to an engine intake passage downstream of the intake compressor and charge air cooler may be actuated to a first position to allow fluidic communication between the ejector and the engine intake passage downstream of the compressor and the charge air cooler. At 210, a canister vent valve (such as CVV 172 in FIG. 1A) housed in a vent line downstream of a fuel vapor canister may be actuated to a closed position to disconnect the EVAP system from the atmosphere.

At 212, a canister purge valve (such as CPV 158 in FIG. 1A) may be actuated to an open position to establish fluidic connection between a port of the ejector and the fuel system. Also, a fuel tank isolation valve (such as FTIV 191 in FIG. 1A) may be actuated to an open position to allow fluidic communication between the fuel vapor canister and the fuel tank. Due to the boosted engine operation, compressed air (under higher pressure) from downstream of the charge air cooler may enter the ejector via the purge system valve and a first port of the ejector. The compressed air may flow through the ejector and enter the intake passage upstream of the intake compressor via a third port of the ejector. As the compressed air flows through the orifice, a vacuum (lower pressure region) may be created at a second port of the ejector located adjacent to the orifice between the first port and the third port. The vacuum generated may cause a check valve (such as second check valve CV2 170 in FIG. 1A) positioned between the second port of the ejector and the CPV to be opened. Opening of the check valve, the CPV, and the FTIV establishes a fluidic connection between the second port of the ejector and the fuel tank via the purge line and the fuel vapor canister. Since the CVS is closed, the fuel system and the EVAP system is sealed and the vacuum generated at the ejector may evacuate the EVAP system and the fuel system. Air from the EVAP system may be routed to the intake passage upstream of the compressor via the ejector. At 214, the evacuation of the EVAP system may be monitored via a change (such as a drop) in fuel tank pressure as estimated via an EVAP system pressure sensor (such as pressure sensor 107 in FIG. 1A) coupled proximal to the fuel tank. In one example, the pressure sensor may be coupled between the fuel tank and the fuel vapor canister.

At 216, the routine includes determining if a level of vacuum building in the EVAP system higher than a threshold level within a threshold duration. A threshold level of vacuum may correspond to a lower than atmospheric vacuum level. In one example, the threshold level may be pre-calibrated to be −4 in $H_2O$. The threshold duration may be pre-calibrated based on a time taken to evacuate the EVAP system and the fuel system during boosted engine operation immediately after installation of the EVAP system and the fuel system. As the air is being sucked out of the EVAP system due to the vacuum generated at the ejector, vacuum (lower pressure) may build up at the EVAP system and the fuel system.

If it is determined that the threshold level of vacuum has built up in the EVAP system within the threshold duration, it may be inferred that that the ejector and the check valve (CV2) positioned between the second port of the ejector and the CPV, and the CPV are not blocked allowing a vacuum to be generated at the ejector, and the EVAP system and the fuel system to be evacuated via the purge line. At 217, the routine includes indicating that the check valve positioned between the second port of the ejector and the CPV, and the ejector are not blocked or stuck closed. The diagnostic routine for the purge system may be completed. The CPV and the CVV may be actuated to open or closed positions based on a purge schedule of the canister.

If it is determined that the threshold level of vacuum has not built up in the EVAP system within the threshold duration, it may be inferred that either a vacuum is not generated at the ejector, or due to a block in the purge line, the EVAP system and the fuel system could not be evacuated. At 220, the method includes indicating the ejector and/or the check valve positioned between the second port of the ejector and the CPV may be potentially blocked, inhibiting vacuum generation at the ejector and/or evacuation of the EVAP system. Over time, with use, contaminants may be lodged within the orifice of the ejector thereby blocking the ejector and hindering flow of compressed air through the ejector. However, the inability to evacuate the EVAP system may be caused due to a degradation in the EVAP system such as the CPV being stuck closed, the FTIV being stuck closed, and/or the CVV being stuck open. Therefore to confirm the integrity of the EVAP system and confirm that the lack of vacuum in the EVAP system and the fuel system is due to a blockage in the purge system such as the ejector and/or the check valve being blocked, a diagnostics of the EVAP system is being opportunistically carried out in FIG. 3.

Figure 3:
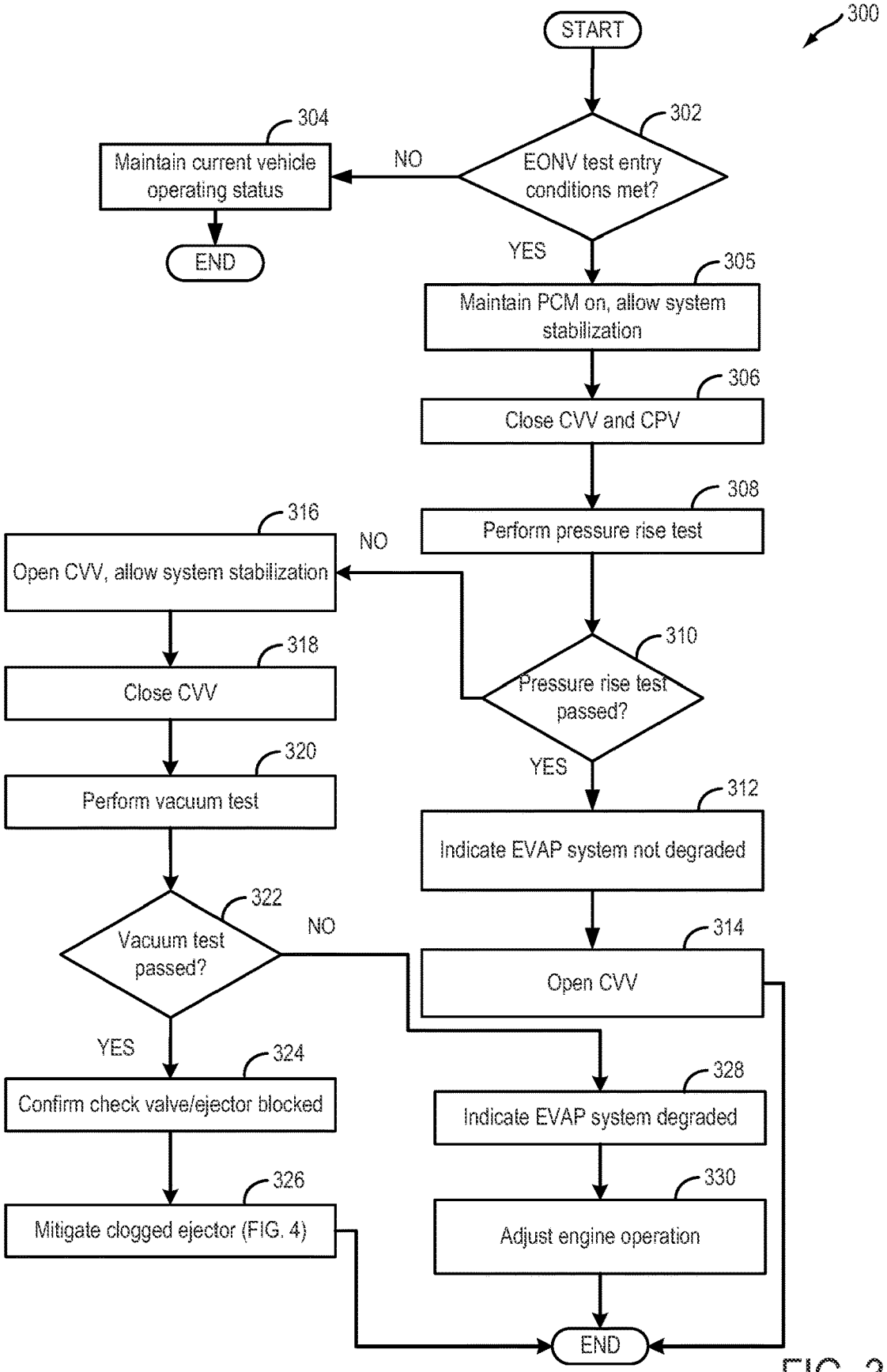
FIG. 3 shows a flowchart for an example method for diagnostics of an evaporative emissions control (EAVP) system.

In this example, an engine-off natural vacuum test is described in FIG. 3 for diagnosis of the EVAP system. However, other diagnostics tests that confirm integrity of the EVAP system may also be carried out. As an example, under natural aspiration conditions (e.g. intake manifold vacuum conditions), a changeover valve (COV) of an evaporative leak check monitor (ELCM) may be configured in a second position (e.g. closed) to seal the fuel vapor canister from atmosphere, and CPV may be commanded open. By commanding ELCM COV to the second position and commanding open CPV during natural aspiration conditions, the evaporative emissions control system and fuel system may be evacuated in order to ascertain the presence or absence of undesired evaporative emissions. Pressure in the fuel system and evaporative emissions control system may be monitored, for example, via a pressure sensor. In some examples pressure sensor may comprise a fuel tank pressure transducer (FTPT). If a threshold vacuum (e.g., negative pressure threshold with respect to atmospheric pressure) is reached during evacuating the evaporative emissions control system and fuel system, an absence of gross undesired evaporative emissions may be indicated and integrity of the EVAP system may be confirmed. Furthermore, if the threshold vacuum is reached, then it may be indicated that a first check valve (such as CV1 153 in FIG. 1A) positioned between the CPV and the intake manifold (downstream of a throttle) is not stuck closed or substantially closed, as in a case where the first check valve is stuck closed, pressure sensor may not indicate pressure changes.

FIG. 3 shows an example method 300 for diagnostics of an evaporative emissions control system (such as EVAP system 154 in FIG. 1A). Method 300 may be carried upon indication of possible blockage in the fuel vapor purge system as detected in FIG. 2 and FIG. 3 may be carried out as a continuation of step 222 in FIG. 3.

At 302, the routine includes determining if conditions are met for carrying out an engine-off natural vacuum (EONV) test. Conditions for an EOONVV test may include a vehicle-off condition with the engine at rest. The vehicle-off condition may include an engine-off event, and may be indicated by other events, such as a key-off event. The vehicle off event may follow a vehicle run time duration, the vehicle run time duration commencing at a previous vehicle-on event. Further entry conditions may include a threshold length of engine run time prior to the engine-off event, a threshold amount of fuel in the fuel tank, and a threshold battery state of charge. If it is determined that entry conditions are not met for the ENOV test, at 304, current engine operation may be maintained without initiation of the ENOV test.

If it is determined that entry conditions are met for the ENOV test, at 305, method 300 may include maintaining the PCM on despite the engine-off and/or vehicle off condition. In this way, the method may continue to be carried out by the controller. Further, the fuel system may be allowed to stabilize following the engine-off condition. Allowing the fuel system to stabilize may include waiting for a period of time before method 300 advances. The stabilization period may be a pre-determined amount of time, or may be an amount of time based on current operating conditions. The stabilization period may be based on the predicted ambient conditions. In some examples, the stabilization period may be characterized as the length of time necessary for consecutive measurements of a parameter to be within a threshold of each other. For example, fuel may be returned to the fuel tank from other fuel system components following an engine off condition. The stabilization period may thus end when two or more consecutive fuel level measurements are within a threshold amount of each other, signifying that the fuel level in the fuel tank has reached a steady-state. In some examples, the stabilization period may end when the fuel tank pressure is equal to atmospheric pressure.

At 306, the canister vent valve (CVV) may be commanded to a closed position and the canister purge valve (CPV), if open, may be commanded to an open position. Also, additionally or alternatively, a fuel tank isolation valve (FTIV) may be closed. In this way, the fuel tank may be isolated from atmosphere.

At 308, method 300 may include performing a pressure rise test. While the engine is still cooling down post shutdown, there may be additional heat rejected to the fuel tank. With the fuel system sealed via the closing of the CVV, the pressure in the fuel tank may rise due to fuel volatizing with increased temperature. The pressure rise test may include monitoring fuel tank pressure for a period of time. Fuel tank pressure may be monitored until the pressure reaches a threshold pressure, the threshold pressure indicative of no leaks above a threshold size in the fuel tank. In some examples, the rate of pressure change may be compared to an expected rate of pressure change. The fuel tank pressure may not reach the threshold pressure. Rather the fuel tank pressure may be monitored for a predetermined amount of time, or an amount of time based on the current conditions. The fuel tank pressure may be monitored until consecutive measurements are within a threshold amount of each other, or until a pressure measurement is less than the previous pressure measurement. The fuel tank pressure may be monitored until the fuel tank temperature stabilizes.

At 310, the method may include determining whether the pressure rise test ended due to a passing result, such as the fuel tank pressure reaching the adjusted pressure threshold. If the pressure rise test resulted in a passing result, method 300 may proceed to 312. At 312, a passing result may be recorded and it may be indicated that the EVAP system is not degraded. Continuing at 314, the canister vent valve may be reopened. In this way, the fuel system pressure may be returned to atmospheric pressure. Method 300 may then end.

If the pressure rise test did not result in a pass based on the adjusted threshold, method 300 may proceed to 316. At 316, the CVV may be opened and the system may be allowed to stabilize. Opening the CVV allows the fuel system pressure to equilibrate to atmospheric pressure. The system may be allowed to stabilize until the fuel tank pressure reaches atmospheric pressure, and/or until consecutive pressure readings are within a threshold of each other. Method 300 may then proceed to 318.

At 318, the CVV may be actuated to a closed position. In this way, the fuel tank may be isolated from atmosphere. As the fuel tank cools, the fuel vapors should condense into liquid fuel, creating a vacuum within the sealed tank. At 320, a vacuum test may be performed. Performing a vacuum test may include monitoring fuel tank pressure for a duration. Fuel tank pressure may be monitored until the vacuum reaches the adjusted threshold, the adjusted threshold vacuum indicative of no leaks above a threshold size in the fuel tank. In some examples, the rate of pressure change may be compared to an expected rate of pressure change. The fuel tank pressure may not reach the threshold vacuum. Rather the fuel tank pressure may be monitored for a predetermined duration, or a duration based on the current conditions.

At 322, the method includes determining if a passing result was indicated for the vacuum test. If the vacuum test resulted in a passing result, it may be inferred that the EVAP system is not degraded. Consequently, it may be confirmed that the lack of vacuum generation during the purge system diagnostics (as discussed in FIG. 2) is due to a blocked ejector or check valve positioned between the second port of the ejector and not due to a blocked CPV. At 324, blockage in the check valve positioned between the second port of the ejector and the CPV or the ejector may be confirmed. At 326, mitigation of a clogged ejector may be carried out by forcing pressurized air to flow through the ejector in a direction opposite to the direction of air flow through the ejector during purging of the EVAP system. Details of the mitigating method is described in FIG. 4.

If at 322 it is indicated that the vacuum test was not passed, it may be inferred that there is a degradation in the EVAP system such as a blockage in the CPV, and the method may proceed to 328. At 328, method 300 may include indicating degradation of the EVAP system and setting a diagnostic code. In response to indication of degradation of the EVAP system, at 330, engine operation may be adjusted to account for the degradation. In one example, the canister purge schedule may be updated. Therein, in one example, the CPV is held closed and canister purging maintained in a disabled state until degradation of the EVAP system has been rectified (such as by a service technician resetting the flag). In another example, a first default maximum purge flow is determined for engine operation during the condition when the flag for a degraded EVAP fuel system is set. This first maximum purge flow may be lower than a second maximum purge flow allowed during regular engine operation with no flag set. In response to the indication of EVAP system degradation, while operating the vehicle engine, even if a desired purge flow is greater than the first maximum flow, the actual purge flow is limited to the first maximum purge flow (or a lower value). In comparison, when no flag is set (and no degradation of the EVAP system is detected), purge flow is provided without being limited to the first maximum purge flow.

Figure 4:
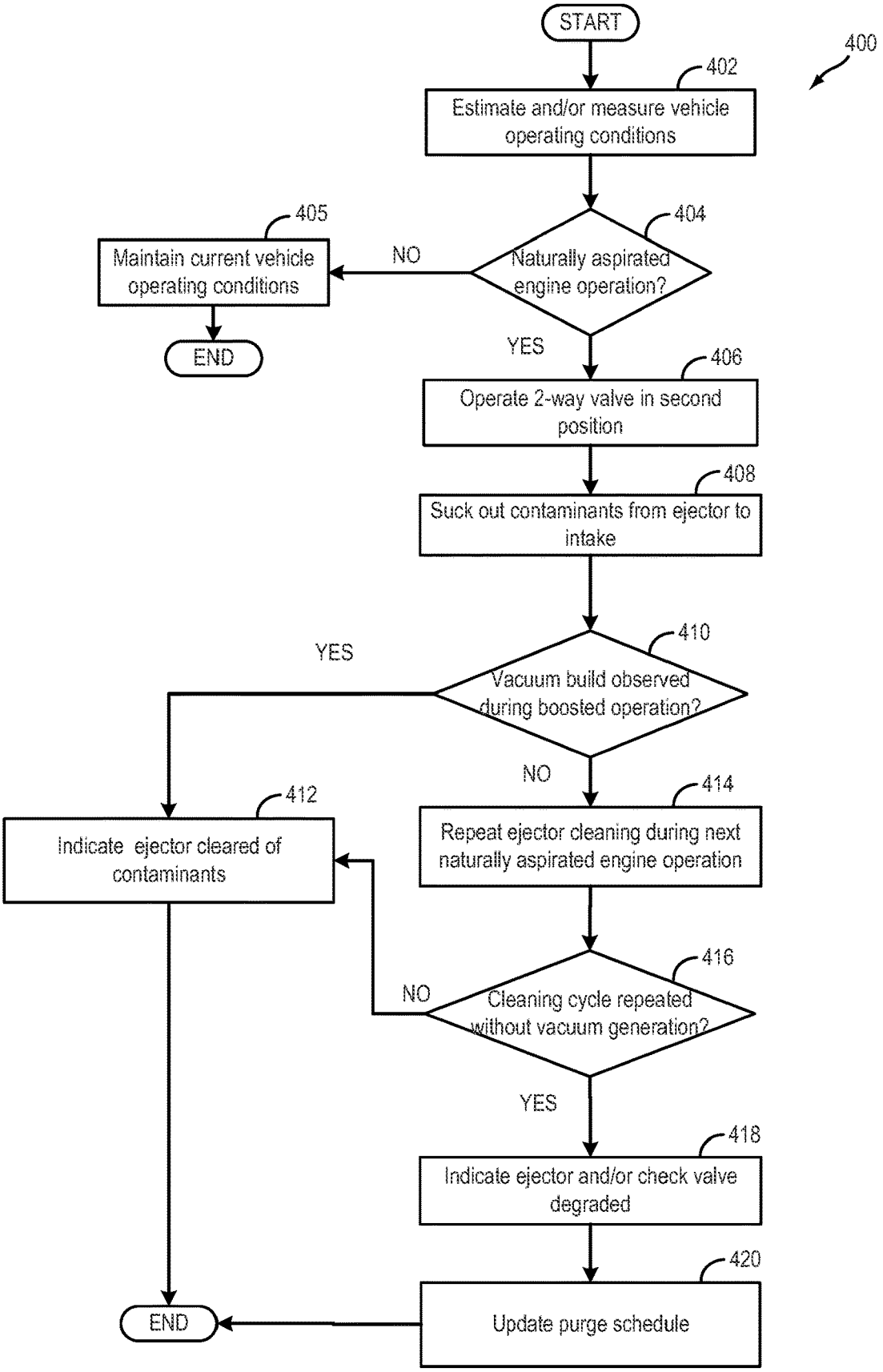
FIG. 4 shows a flowchart for an example method for mitigation of a clogged ejector.
Figure 5:
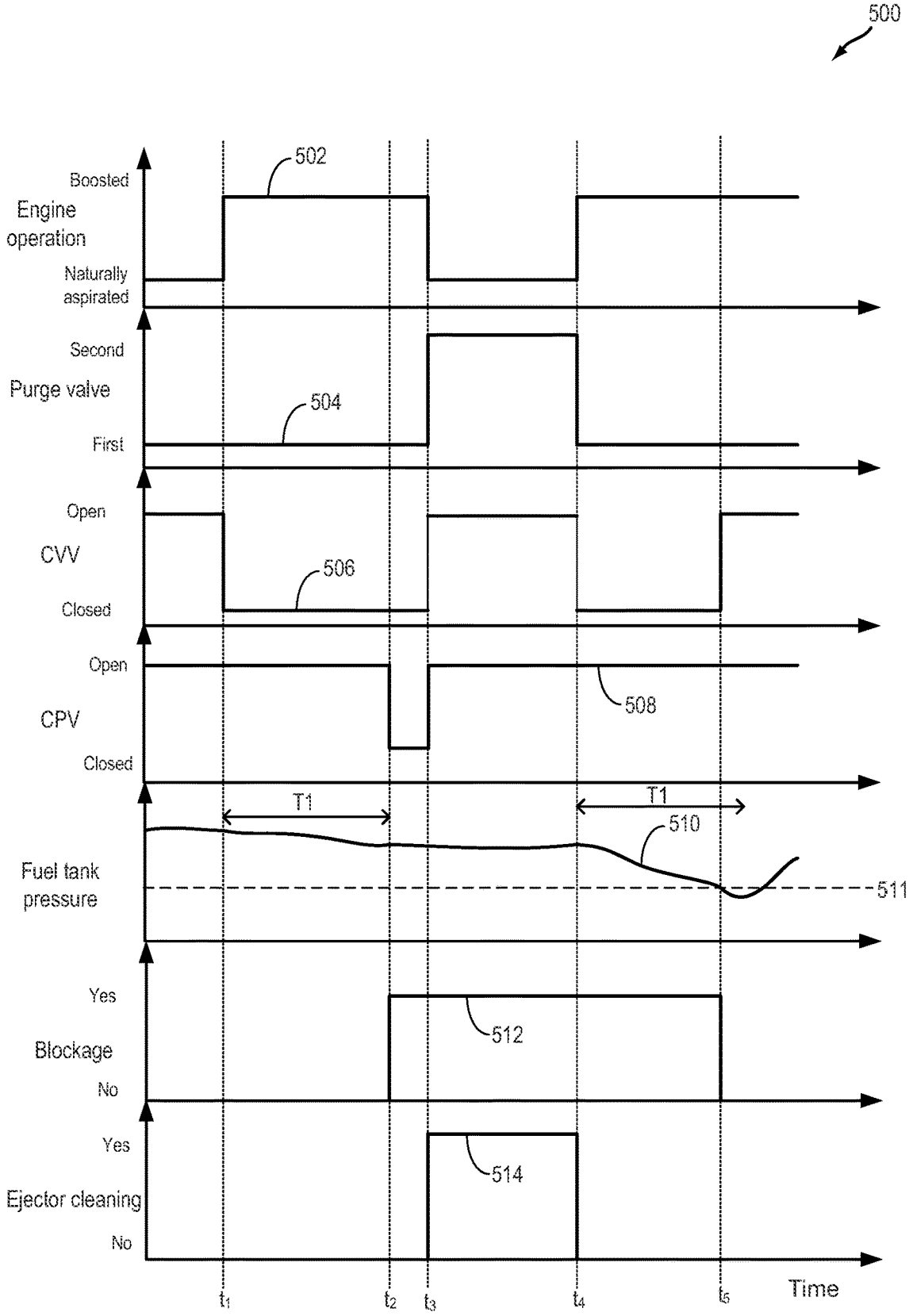
FIG. 5 shows an example diagnosis of the ejector followed by mitigation of a clogged ejector.

FIG. 4 shows an example method 400 for mitigation of a clogged ejector. Method 400 may be carried out upon confirmation of blocking of the ejector and/or a check valve check valve positioned between the second port of the ejector and the CPV of the fuel vapor purge system. Method 400 may be part of method 300 and may be carried out at step 326 of method 300.

At 402, the method includes estimating and/or measuring vehicle and engine operating conditions. These include, for example, engine speed, torque demand, manifold pressure, manifold air flow, ambient conditions (ambient temperature, pressure, and humidity, for example), engine dilution, etc. It may be estimated if the engine is operating under naturally aspirated or under boosted condition. The engine may be operated in the naturally aspirated condition during a lower engine load condition when the compressor is not operated to provide boost pressure. In absence of boost pressure, engine operation causes a lower pressure (vacuum) in the intake manifold. The engine may be operated in boost conditions during a higher engine load condition with intake manifold pressure greater than atmospheric pressure. During boosted engine operation, an intake compressor may be operated either via an exhaust turbine or an electric motor to provide the boost pressure.

At 404, the routine includes determining if the engine is operated in a naturally aspirated condition. Natural aspiration of the engine may be confirmed by a lower than atmospheric pressure at the engine intake manifold as estimated via a manifold air pressure sensor. Further, a naturally aspirated operation may be confirmed by a deactivated state of an intake compressor (thereby not providing boost pressure). If it is confirmed that the engine is not operated under naturally aspirated conditions such as when the engine is operated under boost pressure, at 405, current vehicle operating conditions may be maintained without initiation of ejector cleaning.

If it is confirmed that the engine is operated under naturally aspirated conditions, at 406, a purge system valve (such as two-way valve 180 in FIG. 1A) of the fuel vapor purge system positioned between the ejector and the intake manifold may be actuated to a second position. In the second position, fluidic communication is established between the engine intake manifold downstream of a throttle and a first port of the ejector via one or more passages (such as second passage 149 and third passage 147 in FIG. 1A). Due to the presence of vacuum (lower pressure) in the engine intake manifold downstream of the throttle, air from the ejector may be sucked out (such as from the orifice of the ejector) to the intake manifold via the first port of the ejector and the two-way valve.

At 408, the engine intake manifold vacuum may suck out contaminants stuck in the ejector to the intake manifold. The contaminants may then be combusted in the engine combustion chambers. As the contaminants are sucked out of the ejector, the blockage of the ejector may be cleared out. In one example, the cleaning of the ejector (such as by maintaining the two-way valve in the second position) may be continued throughout the duration of engine operation in the naturally aspirated condition until engine operation changes to boosted operation.

Upon change of engine operation from naturally aspirated to boosted operation as evidenced by operation of the intake compressor and an increase in intake manifold pressure, at 410, the routine includes determining if a vacuum build is observed in the EVAP system upon. In order to allow vacuum to build in the EVAP system, steps 208-214 of method 200 (FIG. 2) may be carried out. Vacuum build may be observed if a level of vacuum in the EVAP system is higher than a threshold level within a threshold duration.

The purge system valve may be actuated to a first position to allow fluidic communication between the ejector and the engine intake passage downstream of the compressor and the charge air cooler. The CVV may be closed while the each of the CPV and the FTIV may be opened to allow fluidic communication between the ejector and the fuel system while the EVAP system is sealed from the atmosphere. Due to the boosted engine operation, compressed air (under higher pressure) from downstream of the charge air cooler may enter the ejector via the purge system valve and a first port of the ejector. The compressed air may flow through the ejector and enter the intake passage upstream of the intake compressor via a third port of the ejector. As the compressed air flows through the orifice, a vacuum may be generated at a second port of the ejector located adjacent to the orifice between the first port and the third port. The vacuum generated may cause a check valve positioned between the second port of the ejector and the CPV to be opened. Opening of the check valve, the CPV, and the FTIV establishes a fluidic connection between the second port of the ejector and the fuel tank via the purge line and the fuel vapor canister. Air from the EVAP system may be routed to the intake passage upstream of the compressor via the ejector generating a vacuum in the EVAP system. The evacuation of the EVAP system may be monitored via a change an EVAP system pressure sensor coupled proximal to the fuel tank. If the suction of air through the ejector during the naturally aspirated engine operation has cleared the contamination in the ejector, a vacuum may be generated at the ejector causing the EVAP system to evacuate.

If it is determined that the level of vacuum in the EVAP system is higher than the threshold level within the threshold duration, it may be inferred that vacuum could be generated at the ejector and there are no blockages in the purge system. At 412, the method includes indicating that the contamination in the ejector could be cleared during the prior naturally aspirated engine operation. Further it is confirmed that the check valve (CV2) positioned between the second port of the ejector and the CPV is not stuck closed or blocked. The ejector and the check valve may be continued to be used for purging the EVAP system during boosted engine operation. In this way, a contamination of the ejector may be mitigated without external interference.

However, if at 410 it is determined that the level of vacuum in the EVAP system is lower than the threshold level within the threshold duration, it may be inferred that vacuum could not be built in the EVAP system during boosted engine operation. At 414, cleaning of the contaminated ejector may be carried out following the steps 406 and 408 during the next naturally aspirated engine operation. As an example, after each cleaning routine during a naturally aspirated engine operation, vacuum build in the EVAP system may be checked (via step 410) in a subsequent boosted engine operation. If vacuum is not generated in the EVAP system, it may be inferred that the ejector remains completely or partially contaminated and/or the check valve positioned between the second port of the ejector and the CPV is stuck closed. A cleaning (mitigation) cycle for the ejector may include a cleaning routine carried out during a naturally aspirated engine operation followed by a check if vacuum is generated in the EVAP system during a boosted engine operation. The cleaning cycle may be repeated n number of times where n is a pre-determined number. In one example, n may be three such that the cleaning cycle may be repeated up to three times to remove contaminants from the ejector.

At 416, the routine includes determining if the cleaning cycle has been repeated n number of times without observing vacuum generation in a sealed EVAP system during a boosted engine operation. If it is determined that after two or more cleaning cycles, vacuum could be generated in the sealed EVAP system during a boosted engine operation, it may be inferred that there are no blockages in the purge system. The method may proceed to step 412 wherein it may be indicated that the ejector has been cleared of all contaminants.

However, if at 416 it is determined that even after repeating the cleaning cycle for n number of times, vacuum generation is not observed in the EVAP system, it may be inferred that blockage remains in the fuel vapor purge system. At 418, the method includes indicating that the ejector and/or the check valve positioned between the second port of the ejector and the CPV is degraded such as blocked inhibiting generation of vacuum at the ejector and/or evacuation of the EVAP system. In one example, the check valve may be stuck in a closed position. A diagnostic code (flag) may be set indicating the degradation of the ejector and/or the check valve.

In response to indication of degradation of the ejector and/or the check valve, at 420, purge schedule of the canister may be updated. As an example, the canister may be purged only during naturally aspirated engine operation. During naturally aspirated engine operation, CPV may be opened and another check valve positioned between the CPV and the engine intake manifold downstream of the throttle may be opened due to engine intake manifold vacuum to establish fluidic connection between the fuel vapor canister and the intake manifold. Purging of the canister may be disabled during boosted engine operation by maintaining the CPV closed. Also, upon detection of degradation of the ejector and/or the check valve, then engine may be operated in a torque limited mode in order to clean out the canister during a higher than threshold canister loading condition (suppress boost mode). As an example, wastegate may be opened to reduce boost pressures.

In this way, during a first condition, a purge system valve may be actuated to a first position to purge a fuel vapor canister of an engine evaporative emissions control (EVAP) system to an engine intake passage upstream of an intake compressor via each of a purge line and an ejector, and during a second condition, the purge system valve may be actuated to a second position to route contaminants from the ejector to an engine intake manifold downstream of a throttle. The first condition may include engine operation under boosted conditions with the intake compressor operating to supply pressurized air to the engine intake manifold, and the second condition may include engine operation under naturally aspirated conditions with the intake compressor disabled and a lower than threshold pressure at the engine intake manifold.

FIG. 5 shows an example timeline 500 illustrating a diagnostics for an ejector (such as ejector 140 in FIG. 1A) of a fuel vapor purge system included in an evaporative emissions control system of a vehicle. The ejector diagnostics is carried out upon confirmation that the EVAP system The horizontal (x-axis) denotes time and the vertical markers t1-t5 identify significant times in the routine for ejector diagnostics and subsequent mitigation.

The first plot, line 502, shows an engine operation condition such as if the engine is operated under a naturally aspirated condition or a boosted condition. The engine is operated in a naturally aspirated condition during a lower engine load condition when the compressor is not operated to provide boost pressure. In absence of boost pressure, engine operation causes a lower pressure (vacuum) in the intake manifold. The engine is operated in a boosted condition during a higher engine load condition with intake manifold pressure greater than atmospheric pressure. During boosted engine operation, an intake compressor is operated either via an exhaust turbine or an electric motor to provide the boost pressure. The second plot, line 504, shows a position of a purge system valve (such as two-way purge system valve 180 in FIG. 1A) coupling the ejector to an engine intake passage downstream of the intake compressor and charge air cooler. The third plot, line 506, shows a position of a canister vent valve (such as CVV 172 in FIG. 1A) housed in a vent line. The fourth plot, line 508, shows a position of a canister purge valve (such as CPV 158 in FIG. 1A) housed in the purge line. The fifth plot, line 510, shows a fuel tank pressure as estimated via a fuel tank pressure sensor (such as FTPT 107 in FIG. 1A). Dashed line 511 denotes a vacuum (lower pressure) level in the EVAP system, the vacuum level lower than atmospheric pressure. The sixth plot, line 512, denotes if a blockage (clogging) is detected in the ejector. The seventh plot, line 514, denotes an ejector cleaning routine that is carried out in response to detection of a clogged ejector.

Prior to time t1, the engine is operated as a naturally aspirated engine. The purge system valve is in a first position allowing fluidic communication between the engine intake manifold downstream of the compressor and a charge air cooler and the ejector. The CVV and the CPV are in respective open positions allowing fresh air to be drawn in via a vent line and the canister to be purged via a purge conduit coupling the purge line to the engine intake manifold downstream of the throttle. The engine vacuum allows the fuel vapor to be drawn into the engine intake manifold through the purge conduit. A positive pressure is maintained at the fuel tank pressure. The ejector is not detected to be blocked and consequently cleaning of the ejector is not being carried out.

At time t1, engine operation is shifted from naturally aspirated operation to a boosted operation due to a change in engine load. In the boosted operation, an intake compressor is operated to generate a higher pressure at the engine intake manifold. Between time t1 and t2, a diagnostic routine for the ejector is carried out to determine integrity of the ejector. The CVV is closed to seal the EVAP system from the atmosphere. As the CPV is opened along with a fuel tank isolation valve (not shown), a fluidic communication is established between a second port of the ejector, the EAVP system, and the fuel tank. Due to the boosted engine operation, if the ejector is not blocked compressed air from the intake manifold would enter the ejector via the purge system valve and a first port of the ejector. The compressed air would pass through an orifice of the ejector and exit to an intake passage upstream of the compressor via a third port of the ejector. As the compressed air flows through the ejector, a vacuum would be generated at the ejector. The vacuum at the ejector would allow evacuation of the EVAP system which would be manifested as a drop in pressure at the fuel tank. If the fuel tank pressure drops to the threshold pressure 511 with a threshold duration T1, it is inferred that the ejector is not blocked and vacuum is being generated at the ejector.

However, at the end of the threshold duration, at time t2, it is observed that the fuel tank pressure remains above the threshold pressure 511 indicating a blockage in the fuel vapor purge system. The blockage can include a clogged ejector with contaminants lodged in an orifice of the ejector. Due to the blockage in the ejector, a vacuum is not generated at the ejector and consequently the EVAP system is not being evacuated. At time t2, the blockage in the ejector is indicated such as by setting a diagnostics code. Due to the blockage in the ejector, purging of the canister cannot be carried out during boosted engine operations. Therefore, upon detection of a clogged ejector, at time t2, the CPV is actuated to a closed position. Between time t2 and t3, the engine is continued to be operated under boosted conditions.

At time t3, engine operation is transitioned from boosted engine operation to naturally aspirated engine operation due to change in engine load. Since the engine is now operating under naturally aspirated condition, purging of the canister is resumed by opening the CPV and the CVV. Fresh air drawn in through the CVV desorbs fuel vapor from the canister which is then routed to the intake manifold downstream of the throttle via a purge line, the CPV, and a purge conduit.

While the engine is operated under naturally aspirated conditions, between time t3 and t4, an ejector cleaning routine is carried out to dislodge the contaminants from the ejector. The purge system valve is actuated from the first position to a second position to allow fluidic communication of the engine intake manifold downstream of a throttle with the ejector via the purge line. Due to the intake manifold vacuum, the contaminants lodged in the ejector is sucked out to the intake manifold via a passage communicating the purge line to a first port of the ejector. In this way, by using intake manifold vacuum during naturally aspirated engine operation, the contaminants from the ejector may be drawn out and routed to the combustion chambers.

At time t4, engine operation is shifted from naturally aspirated operation to a boosted operation due to a change in engine load and the ejector cleaning routine is concluded. The purge system valve is actuated to the first position to allow fluidic communication between the engine intake manifold downstream of the compressor and a charge air cooler and the ejector. At t4, the diagnostic routine for the ejector is repeated to ensure that the blockage has been cleared during the previous ejector cleaning routine. The CVV is closed to seal the EVAP system from the atmosphere and the CPV is maintained open along with the fuel tank isolation valve (not shown) to establish a fluidic communication is established between the second port of the ejector, the EAVP system, and the fuel tank. Due to the boosted engine operation, compressed air from the intake manifold enters the ejector via the purge system valve and a first port of the ejector. The compressed air passes through the orifice of the ejector and exits to an intake passage upstream of the compressor via a third port of the ejector. As the compressed air flows through the ejector, a vacuum would be generated at the ejector. The vacuum at the ejector allows evacuation of the EVAP system which is manifested as a drop in pressure at the fuel tank.

At time t5, in response to the fuel tank pressure dropping to the threshold pressure 511 within the threshold duration T1, it is inferred that the ejector cleaning has been successful and the ejector is not blocked allowing vacuum to be generated at the ejector. The diagnostic code corresponding to the blockage may be turned off. After time t5, the CVV is reopened and purging of the canister can be carried out during boosted conditions by using the vacuum generated at the ejector.

In this way, by including a two-way purge system valve between an ejector of a fuel vapor purge system and an engine intake manifold, a blockage in the ejector may be diagnosed during a boosted engine operation and consequently, and the ejector may be cleaned during a subsequent naturally aspirated engine operation. By diagnosing a clogged ejector and then mitigating the clog, purging of the fuel vapor canister may be continued during both boosted and naturally aspirated engine operation. Overall, by ensuring effective purging of the canister during all engine operating conditions, emissions quality may be improved.

In one example, a method for an engine of a vehicle, comprising: in response to indication of blockage in a fuel vapor purge system, actuating a purge system valve to a second position to route contaminants from the ejector to an engine intake manifold. In the preceding example, additionally or optionally, the fuel vapor purge system of an engine evaporative emissions control (EVAP) system includes each of a first purge conduit coupling a canister purge valve (CPV) to the engine intake manifold downstream of a throttle, the ejector, a second purge conduit coupling the CPV to the ejector, a third purge conduit coupling the ejector to an intake passage upstream of an intake compressor, and the purge system valve. In any or all of the preceding examples, additionally or optionally, the first purge conduit includes a first check valve positioned between the CPV and the engine intake manifold, the first check valve opening in presence of a lower than threshold pressure in the engine intake manifold, and wherein the second purge conduit including a second check valve positioned between the CPV and a second port of the ejector, the second check valve opening in presence of a lower than threshold pressure at the second port of the ejector. In any or all of the preceding examples, additionally or optionally, the purge system valve is a two-way valve with a first end of the purge system valve coupled to a first port of the ejector, a second end of the purge system valve coupled to the engine intake manifold between the intake compressor and the throttle at a first position of the purge system valve, and the second end of the purge system valve coupled to the first purge conduit at the second position of the purge system valve. In any or all of the preceding examples, additionally or optionally, blockage in the fuel vapor purge system is indicated in response to a pressure in a fuel tank being above a threshold pressure upon completion of a diagnostic routine of the fuel vapor purge system carried out during boosted operation of the engine, the threshold pressure corresponding to a lower than atmospheric pressure. In any or all of the preceding examples, additionally or optionally, the diagnostic routine includes, during the boosted operation of the engine, closing a canister vent valve (CVV) housed in a vent line of fuel vapor canister, opening the CPV housed in a purge line of the fuel vapor canister, actuating the purge system valve to the first position to route compressed air from downstream of the compressor to upstream of the compressor via the ejector, and monitoring a change in the pressure in the fuel tank over a threshold duration. In any or all of the preceding examples, additionally or optionally, routing of compressed air through the ejector generates the lower than threshold pressure at the second port of the ejector which causes evacuation of the EVAP system through the purge line. In any or all of the preceding examples, additionally or optionally, the routing of the contaminants from the ejector to the engine intake manifold includes, during operation of the engine under naturally aspirated conditions, cleaning the ejector by routing contaminants from the ejector to the engine intake manifold via the purge system valve and the first purge conduit. In any or all of the preceding examples, additionally or optionally, the cleaning of the ejector is repeated over two or more cycles of engine operation under naturally aspirated conditions. In any or all of the preceding examples, the method further comprising, additionally or optionally, after cleaning the ejector by routing contaminants from the ejector to the engine intake manifold, during an immediately subsequent boosted engine operation, repeating the diagnostic routine of the fuel vapor purge system, and in response to the pressure in the fuel tank reaching the threshold pressure upon completion of the repeated diagnostic routine of the fuel vapor purge system, indicating the fuel vapor purge system not degraded. In any or all of the preceding examples, the method further comprising, additionally or optionally, in response to the pressure in the fuel tank being above the threshold pressure upon completion of the repeated diagnostic routine of the fuel vapor purge system, indicating degradation of the fuel vapor purge system and disabling purging of the fuel vapor canister during subsequent boosted engine operations.

In another example, a method for an engine in a vehicle, comprises: during a first condition, actuating a purge system valve to a first position to purge a fuel vapor canister of an engine evaporative emissions control (EVAP) system to an engine intake passage upstream of an intake compressor via each of a purge line and an ejector; and during a second condition, actuating the purge system valve to a second position to route contaminants from the ejector to an engine intake manifold downstream of a throttle. In the preceding example, additionally or optionally, the first condition includes engine operation under boosted conditions with the intake compressor operating to supply pressurized air to the engine intake manifold, and the second condition includes engine operation under naturally aspirated conditions with the intake compressor disabled and a lower than threshold pressure at the engine intake manifold. In any or all of the preceding examples, additionally or optionally, the routing of contaminants from the ejector to the engine intake manifold is carried out in response to detection of blockage in one of the ejector and a check valve positioned between a canister purge valve (CPV) in the purge line and the ejector during a diagnostic routine of a purge system. In any or all of the preceding examples, additionally or optionally, the diagnostic routine includes, during the first condition, closing a canister vent valve (CVV) housed in a vent line of fuel vapor canister, opening the CPV, opening a fuel tank isolation valve, actuating the purge system valve to the first position to route compressed air from the engine intake manifold through the ejector, and in monitoring a change in a pressure in the fuel tank over a threshold duration. In any or all of the preceding examples, additionally or optionally, the detection of blockage in one of the ejector and the check valve is in response to the pressure not reaching a threshold pressure level upon completion of the threshold duration, the threshold pressure level lower than an atmospheric pressure.

In yet another example, a system for an engine in a vehicle, comprises: a controller with computer-readable instructions stored on non-transitory memory that when executed cause the controller to: during operation of a compressor coupled to an intake passage, actuate a two-way valve coupled between an ejector and an engine intake manifold to a first position allowing flow of compressed air from downstream of the compressor to upstream of the compressor through the ejector to generate a lower than threshold pressure at the ejector, actuate a canister vent valve (CVV) housed in a vent line coupled to a fuel vapor canister to a closed position, actuate a canister purge valve (CPV) housed in a purge line coupled to the fuel vapor canister to an open position, monitor a fuel system pressure via a pressure sensor coupled to a fuel line coupling a fuel tank to the fuel vapor canister over a threshold duration, and in response to the fuel system pressure remaining above a threshold pressure, indicate a blockage in one of the ejector and a check valve housed in a purge line between the CPV and the ejector, the threshold pressure lower than atmospheric pressure. In the preceding example, additionally or optionally, the controller includes further instructions to: in response to indication of blockage in the one of the ejector and the check valve, during an immediately subsequent engine operation without operation of the compressor, actuate the two-way valve to a second position routing contaminants from the ejector to the engine intake manifold via each pf the two-way valve and a purge line to clean the ejector. In any or all of the preceding examples, additionally or optionally, the controller includes further instructions to: during operation of the compressor after cleaning of the ejector, actuate the two-way valve to the first position, actuate the CVV to the closed position, actuate the CPV to the open position, monitor the fuel system pressure over the threshold duration, and in response to the fuel system pressure reaching the threshold pressure, indicate the ejector clean and resume purge of the fuel vapor canister, and in response to the fuel system pressure remaining above the threshold pressure, indicate degradation of the check valve and disable purge of the fuel vapor canister during operation of the compressor. In any or all of the preceding examples, additionally or optionally, purging of the fuel vapor canister during operation of the compressor includes, routing fuel vapor from the purge line to the intake passage downstream of the compressor via the check valve and the ejector, the check valve opening due to the lower than threshold pressure generated at the ejector.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine of a vehicle, comprising:

in response to indication of blockage in a fuel vapor purge system, actuating a purge system valve to a second position to route contaminants from an ejector to an engine intake manifold, wherein blockage in the fuel vapor purge system is indicated in response to a pressure in a fuel tank being above a threshold pressure upon completion of a diagnostic routine of the fuel vapor purge system carried out during boosted operation of the engine, the threshold pressure corresponding to a lower than atmospheric pressure, wherein the purge system valve is a two-way valve with a first end of the purge system valve coupled to a first port of the ejector, a second end of the purge system valve coupled to the engine intake manifold between an intake compressor and a throttle at a first position of the purge system valve, and the second end of the purge system valve coupled to a first purge conduit at the second position of the purge system valve.

2. The method of claim 1, wherein the fuel vapor purge system of an engine evaporative emissions control (EVAP) system includes each of the first purge conduit coupling a canister purge valve (CPV) to the engine intake manifold downstream of the throttle, the ejector, a second purge conduit coupling the CPV to the ejector, a third purge conduit coupling the ejector to an intake passage upstream of the intake compressor, and the purge system valve.

3. The method of claim 2, wherein the first purge conduit includes a first check valve positioned between the CPV and the engine intake manifold, the first check valve opening in presence of a lower than threshold pressure in the engine intake manifold, and wherein the second purge conduit including a second check valve positioned between the CPV and a second port of the ejector, the second check valve opening in presence of a lower than threshold pressure at the second port of the ejector.

4. The method of claim 1, wherein the diagnostic routine includes, during the boosted operation of the engine, closing a canister vent valve (CVV) housed in a vent line of fuel vapor canister, opening a canister purge valve (CPV) housed in a purge line of the fuel vapor canister, actuating the purge system valve to the first position to route compressed air from downstream of the intake compressor to upstream of the intake compressor via the ejector, and monitoring a change in the pressure in the fuel tank over a threshold duration.

5. The method of claim 4, wherein routing of compressed air through the ejector generates the lower than threshold pressure at a second port of the ejector which causes evacuation of an engine evaporative emissions control (EVAP) system through the purge line.

6. The method of claim 4, wherein the routing of the contaminants from the ejector to the engine intake manifold includes, during operation of the engine under naturally aspirated conditions, cleaning the ejector by routing contaminants from the ejector to the engine intake manifold via the purge system valve and the first purge conduit.

7. The method of claim 6, wherein the cleaning of the ejector is repeated over two or more cycles of engine operation under naturally aspirated conditions.

8. The method of claim 6, further comprising, after cleaning the ejector by routing contaminants from the ejector to the engine intake manifold, during an immediately subsequent boosted engine operation, repeating the diagnostic routine of the fuel vapor purge system, and in response to the pressure in the fuel tank reaching the threshold pressure upon completion of the repeated diagnostic routine of the fuel vapor purge system, indicating the fuel vapor purge system not degraded.

9. The method of claim 8, further comprising, in response to the pressure in the fuel tank being above the threshold pressure upon completion of the repeated diagnostic routine of the fuel vapor purge system, indicating degradation of the fuel vapor purge system and disabling purging of the fuel vapor canister during subsequent boosted engine operations.

10. A method for an engine, comprising:

during a first condition, actuating a purge system valve to a first position to purge a fuel vapor canister of an engine evaporative emissions control (EVAP) system to an engine intake passage upstream of an intake compressor via each of a purge line and an ejector; and in response to a pressure in a fuel tank not reaching a threshold pressure level upon completion of a threshold duration during a prior engine operation under the first condition, during a second condition, actuating the purge system valve to a second position to route contaminants from the ejector to an engine intake manifold downstream of a throttle, wherein the routing of contaminants from the ejector to the engine intake manifold is carried out in response to detection of blockage in one of the ejector and a check valve positioned between a canister purge valve (CPV) in the purge line and the ejector during a diagnostic routine of a purge system, and wherein the diagnostic routine includes, during the first condition, closing a canister vent valve (CVV) housed in a vent line of fuel vapor canister, opening the CPV, opening a fuel tank isolation valve, actuating the purge system valve to the first position to route compressed air from the engine intake manifold through the ejector, and in monitoring a change in a pressure in the fuel tank over the threshold duration.

11. The method of claim 10, wherein the first condition includes engine operation under boosted conditions with the intake compressor operating to supply pressurized air to the engine intake manifold, and the second condition includes engine operation under naturally aspirated conditions with the intake compressor disabled and a lower than threshold pressure at the engine intake manifold.

12. The method of claim 10, wherein the threshold pressure level in the fuel tank is lower than an atmospheric pressure.

13. A system for an engine in a vehicle, comprising:

a controller with computer-readable instructions stored on non-transitory memory that when executed cause the controller to:

during operation of a compressor coupled to an intake passage, actuate a two-way valve coupled between an ejector and an engine intake manifold to a first position allowing flow of compressed air from downstream of the compressor to upstream of the compressor through the ejector to generate a lower than threshold pressure at the ejector;

actuate a canister vent valve (CVV) housed in a vent line coupled to a fuel vapor canister to a closed position;

actuate a canister purge valve (CPV) housed in a purge line coupled to the fuel vapor canister to an open position;

monitor a fuel system pressure via a pressure sensor coupled to a fuel line coupling a fuel tank to the fuel vapor canister over a threshold duration; and in response to the fuel system pressure remaining above a threshold pressure, indicate a blockage in one of the ejector and a check valve housed in a purge line between the CPV and the ejector, the threshold pressure lower than atmospheric pressure.

14. The system of claim 13, wherein the controller includes further instructions to:

in response to indication of blockage in the one of the ejector and the check valve, during an immediately subsequent engine operation without operation of the compressor, actuate the two-way valve to a second position routing contaminants from the ejector to the engine intake manifold via each pf the two-way valve and the purge line to clean the ejector.

15. The system of claim 14, wherein the controller includes further instructions to:

during operation of the compressor after cleaning of the ejector, actuate the two-way valve to the first position;

actuate the CVV to the closed position;

actuate the CPV to the open position;

monitor the fuel system pressure over the threshold duration; and in response to the fuel system pressure reaching the threshold pressure, indicate the ejector clean and resume purge of the fuel vapor canister, and in response to the fuel system pressure remaining above the threshold pressure, indicate degradation of the check valve and disable purge of the fuel vapor canister during operation of the compressor.

16. The system of claim 15, wherein purging of the fuel vapor canister during operation of the compressor includes, routing fuel vapor from the purge line to the intake passage downstream of the compressor via the check valve and the ejector, the check valve opening due to the lower than threshold pressure generated at the ejector.

* * * * *